US011365629B1

(12) United States Patent
Mondal et al.

(10) Patent No.: US 11,365,629 B1
(45) Date of Patent: Jun. 21, 2022

(54) FLOW STRUCTURE FOR TURBINE ENGINE

(71) Applicant: General Electric Company, Schenectady, NY (US)

(72) Inventors: Bhaskar Nanda Mondal, Bangalore (IN); Vinod Shashikant Chaudhari, Bangalore (IN); Rajesh Kumar, Bangalore (IN); Thomas Ory Moniz, Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/230,826

(22) Filed: Apr. 14, 2021

(51) Int. Cl.

| | |
|---|---|
| ***F01D 11/02*** | (2006.01) |
| ***F01D 1/26*** | (2006.01) |
| ***F01D 5/03*** | (2006.01) |
| ***F01D 5/08*** | (2006.01) |

(52) U.S. Cl.
CPC ..... *F01D 1/26* (2013.01); *F01D 5/03* (2013.01); *F01D 5/081* (2013.01); *F01D 11/025* (2013.01); *F05D 2260/20* (2013.01)

(58) Field of Classification Search
None
See application file for complete search history.

(56) References Cited

U.S. PATENT DOCUMENTS

| | | | | |
|---|---|---|---|---|
| 4,730,832 | A * | 3/1988 | Cederwall | B23P 19/04 277/321 |
| 5,105,618 | A | 4/1992 | Lardellier | |
| 5,112,191 | A | 5/1992 | Strock et al. | |
| 5,197,281 | A | 3/1993 | Przytulski et al. | |
| 5,749,701 | A | 5/1998 | Clarke et al. | |
| 6,742,783 | B1 * | 6/2004 | Lawer | F01D 11/08 277/412 |
| 7,048,496 | B2 | 5/2006 | Proctor et al. | |
| 8,011,188 | B2 | 9/2011 | Woltmann et al. | |
| 9,175,695 | B2 | 11/2015 | Bulin et al. | |
| 9,234,463 | B2 | 1/2016 | Benjamin et al. | |
| 9,920,645 | B2 | 3/2018 | Mahle et al. | |
| 2016/0237894 | A1 * | 8/2016 | Kupratis | F02C 7/36 |
| 2018/0156045 | A1 | 6/2018 | Clum et al. | |
| 2018/0340689 | A1 * | 11/2018 | Woodlock | F23R 3/002 |
| 2018/0354637 | A1 | 12/2018 | Suciu et al. | |
| 2019/0085710 | A1 * | 3/2019 | van der Merwe | F01D 1/26 |
| 2019/0085711 | A1 * | 3/2019 | Gibson | F02C 3/067 |
| 2019/0085725 | A1 * | 3/2019 | Zatorski | F01D 25/18 |
| 2019/0218913 | A1 | 7/2019 | Sen et al. | |
| 2020/0217510 | A1 * | 7/2020 | Sampath | F23R 3/286 |
| 2021/0262389 | A1 * | 8/2021 | Kalevi Makela | F01D 25/145 |

* cited by examiner

*Primary Examiner* — Michael Lebentritt
(74) *Attorney, Agent, or Firm* — Dority & Manning, P.A.

(57) ABSTRACT

A turbine assembly including a first rotor assembly with a rotatable outer drum from which one or more stages of a plurality of outer drum airfoils is extended radially inward is provided. An outer casing surrounds the outer drum of the first rotor assembly. A seal assembly is coupled to the outer casing and positioned radially outward from an upstream-most stage of the plurality of outer drum airfoils. The seal assembly is positioned in axial alignment with the upstream-most stage of the plurality of outer drum airfoils. The seal assembly separates a first plenum from a second plenum. The second plenum is formed axially aft of the first plenum and is formed by the seal assembly, the outer casing, and the outer drum of the first rotor assembly. The first plenum is positioned radially outward from the upstream-most stage of the plurality of outer drum airfoils.

20 Claims, 6 Drawing Sheets

FLOW STRUCTURE FOR TURBINE ENGINE

FIELD

The present subject matter relates generally to flow structures and thermal management structures for outer drum rotors for interdigitated gas turbine engines.

BACKGROUND

Counter-rotating or interdigitated turbine assemblies may provide improved operating efficiency over conventional non-interdigitated turbine assemblies. However, counter-rotating, interdigitated, or vaneless turbine assemblies are challenged with providing secondary flow cooling or clearance control at rotor drums. Known structures may undesirably utilize relatively large quantities of air from compressors for secondary flow cooling and bearing assembly operation, which adversely impacts fuel burn, propulsive efficiency, or weight of the engine.

As such, there is a need for improved secondary flow structures for interdigitated gas turbine engines.

BRIEF DESCRIPTION

Aspects and advantages of the invention will be set forth in part in the following description, or may be obvious from the description, or may be learned through practice of the invention.

An aspect of the present disclosure is directed to an engine including a turbine assembly including a first rotor assembly with a rotatable outer drum from which one or more stages of a plurality of outer drum airfoils is extended radially inward. An outer casing surrounds the outer drum of the first rotor assembly. A seal assembly is coupled to the outer casing and positioned radially outward from an upstream-most stage of the plurality of outer drum airfoils. The seal assembly is positioned in axial alignment with the upstream-most stage of the plurality of outer drum airfoils. The seal assembly separates a first plenum from a second plenum. The second plenum is formed axially aft of the first plenum and is formed by the seal assembly, the outer casing, and the outer drum of the first rotor assembly. The first plenum is positioned radially outward from the upstream-most stage of the plurality of outer drum airfoils.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
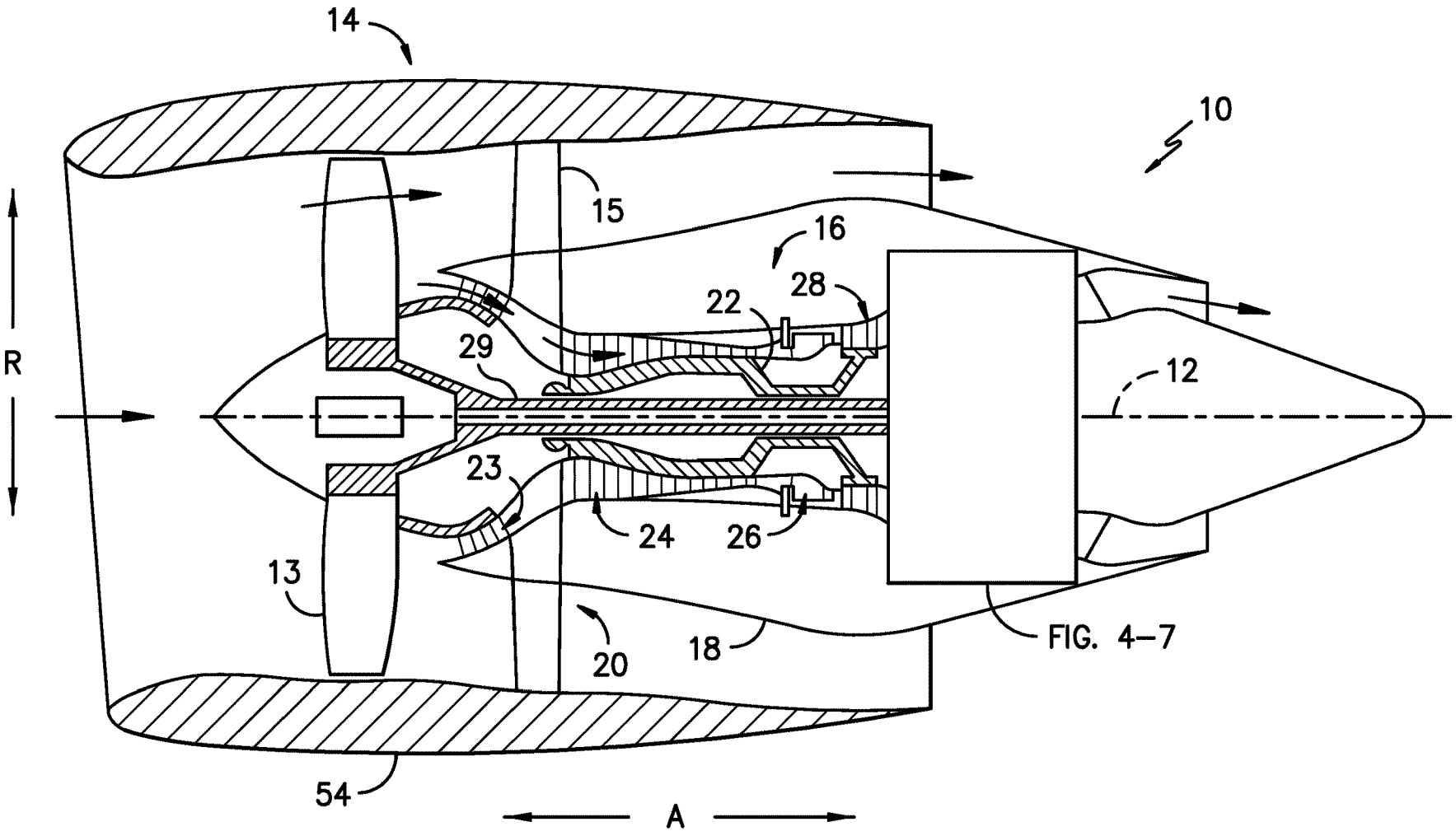
FIG. 1 is a schematic cross-sectional view of an exemplary embodiment of a turbomachine engine including a core engine with a turbine assembly according to an aspect of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

One or more components of the turbomachine engine described herein below may be manufactured or formed using any suitable process, such as an additive manufacturing process, such as a 3-D printing process. The use of such a process may allow such component to be formed integrally, as a single monolithic component, or as any suitable number of sub-components. In particular, the additive manufacturing process may allow such component to be integrally formed and include a variety of features not possible when using prior manufacturing methods. For example, the additive manufacturing methods described herein may allow for the manufacture of gears, housings, conduits, heat exchangers, seals, drums, rotors, or other components having unique features, configurations, thicknesses, materials, densities, fluid passageways, headers, and mounting structures that may not have been possible or practical using prior manufacturing methods. Some of these features are described herein.

Suitable additive manufacturing techniques in accordance with the present disclosure include, for example, Fused Deposition Modeling (FDM), Selective Laser Sintering (SLS), 3D printing such as by inkjets, laser jets, and binder jets, Stereolithography (SLA), Direct Selective Laser Sintering (DSLS), Electron Beam Sintering (EBS), Electron Beam Melting (EBM), Laser Engineered Net Shaping (LENS), Laser Net Shape Manufacturing (LNSM), Direct Metal Deposition (DMD), Digital Light Processing (DLP), Direct Selective Laser Melting (DSLM), Selective Laser Melting (SLM), Direct Metal Laser Melting (DMLM), and other known processes.

Figure 2:
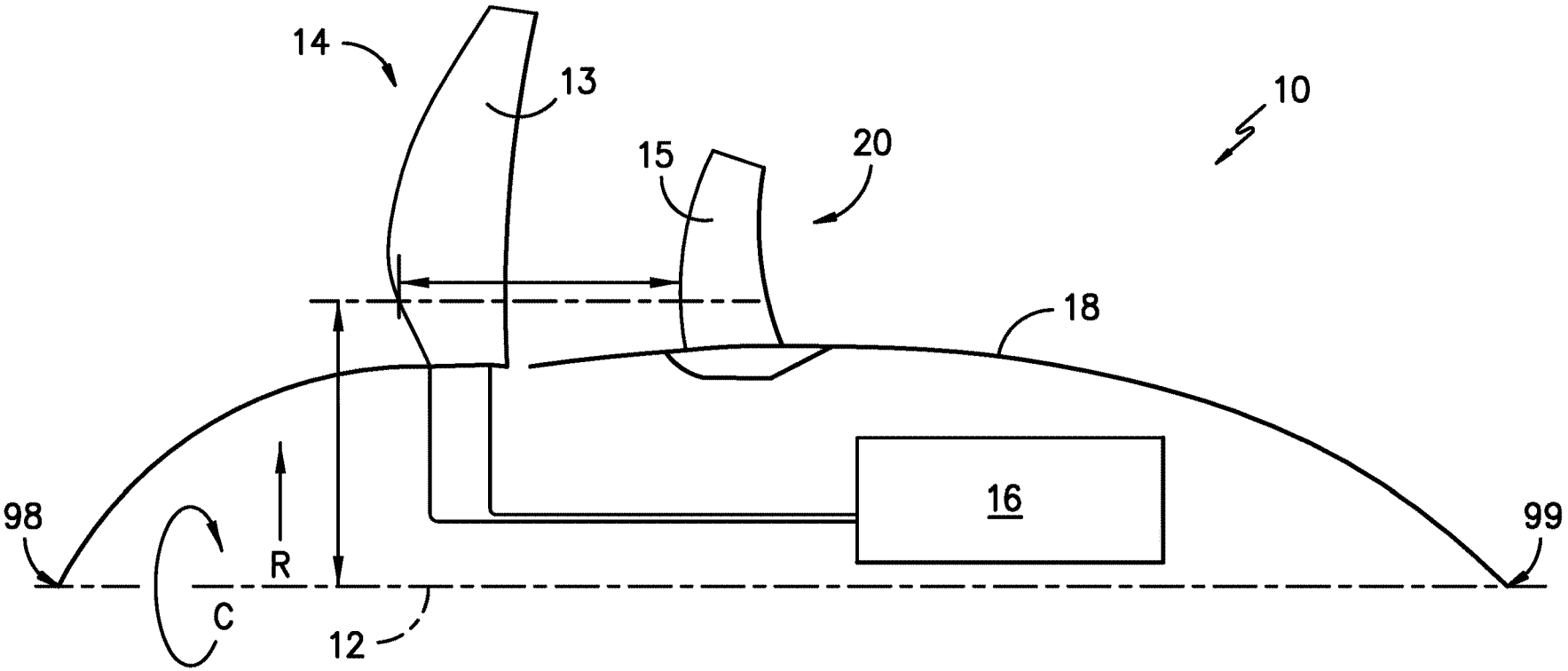
FIG. 2 is a cutaway side view of an exemplary embodiment of a turbomachine engine including a core engine with the turbine assembly according to an aspect of the present disclosure.

Referring now to the drawings, FIGS. 1-2 are exemplary embodiments of an engine 10 including an interdigitated turbine assembly according to aspects of the present disclosure. The engine 10 includes a fan assembly 14 driven by a core engine 16. The core engine 16 is encased in an outer casing 18. In various embodiments, the core engine 16 is generally a Brayton cycle system configured to drive the fan assembly 14. However, in other embodiments, the fan assembly 14 may be driven by a core engine configured as a pressure-rise system or a hybrid-electric system including an electric powertrain with one or more electric machines, energy storage devices, motor/generators, or controllers. The core engine 16 is shrouded, at least in part, by an outer casing 18. The fan assembly 14 includes a plurality of fan blades 13. A vane assembly 20 is extended from the outer casing 18. The vane assembly 20 including a plurality of vanes 15 is positioned in operable arrangement with the fan blades 13 to provide thrust, control thrust vector, abate or re-direct undesired acoustic noise, or otherwise desirably alter a flow of air relative to the fan blades 13.

In certain embodiments, such as depicted in FIGS. 1-2, the vane assembly 20 is positioned downstream or aft of the fan assembly 14. However, it should be appreciated that in some embodiments, the vane assembly 20 may be positioned upstream or forward of the fan assembly 14. In still various embodiments, the engine 10 may include a first vane assembly positioned forward of the fan assembly 14 and a second vane assembly positioned aft of the fan assembly 14. The fan assembly 14 may be configured to desirably adjust pitch at one or more fan blades 13. In certain embodiments, such as depicted at FIG. 2, the adjustable pitch fan blades 13 may control thrust vector, abate or re-direct noise, or alter thrust output. The vane assembly 20 may be configured to desirably adjust pitch at one or more vanes 15, such as to control thrust vector, abate or re-direct noise, or alter thrust output. Pitch control mechanisms at one or both of the fan assembly 14 or the vane assembly 20 may co-operate to produce one or more desired effects described above.

In various embodiments, such as depicted in FIG. 1, the engine 10 is a ducted thrust producing system. The engine 10 may be configured as a turbofan with a nacelle or fan casing 54 surrounding the plurality of fan blades. 13. In certain embodiments, such as depicted in FIG. 2, the engine 10 is an un-ducted thrust producing system, such that the plurality of fan blades 13 is unshrouded by a nacelle or fan casing. As such, in various embodiments, the engine 10 may be configured as an unshrouded turbofan engine, an open rotor engine, or a propfan engine. In particular embodiments, the engine 10 is a single unducted rotor engine including a single row of fan blades 13.

The engine 10 may be configured as a low-bypass or high-bypass engine having suitably sized fan blades 13. The engine 10 configured as an open rotor engine may include the fan assembly 14 having large-diameter fan blades 13, such as may be suitable for high bypass ratios, high cruise speeds (e.g., comparable to aircraft with turbofan engines, or generally higher cruise speed than aircraft with turboprop engines), high cruise altitude (e.g., comparable to aircraft with turbofan engines, or generally high cruise speed than aircraft with turboprop engines), and/or relatively low rotational speeds. Cruise altitude is generally an altitude at which an aircraft levels after climb and prior to descending to an approach flight phase.

Figure 3:
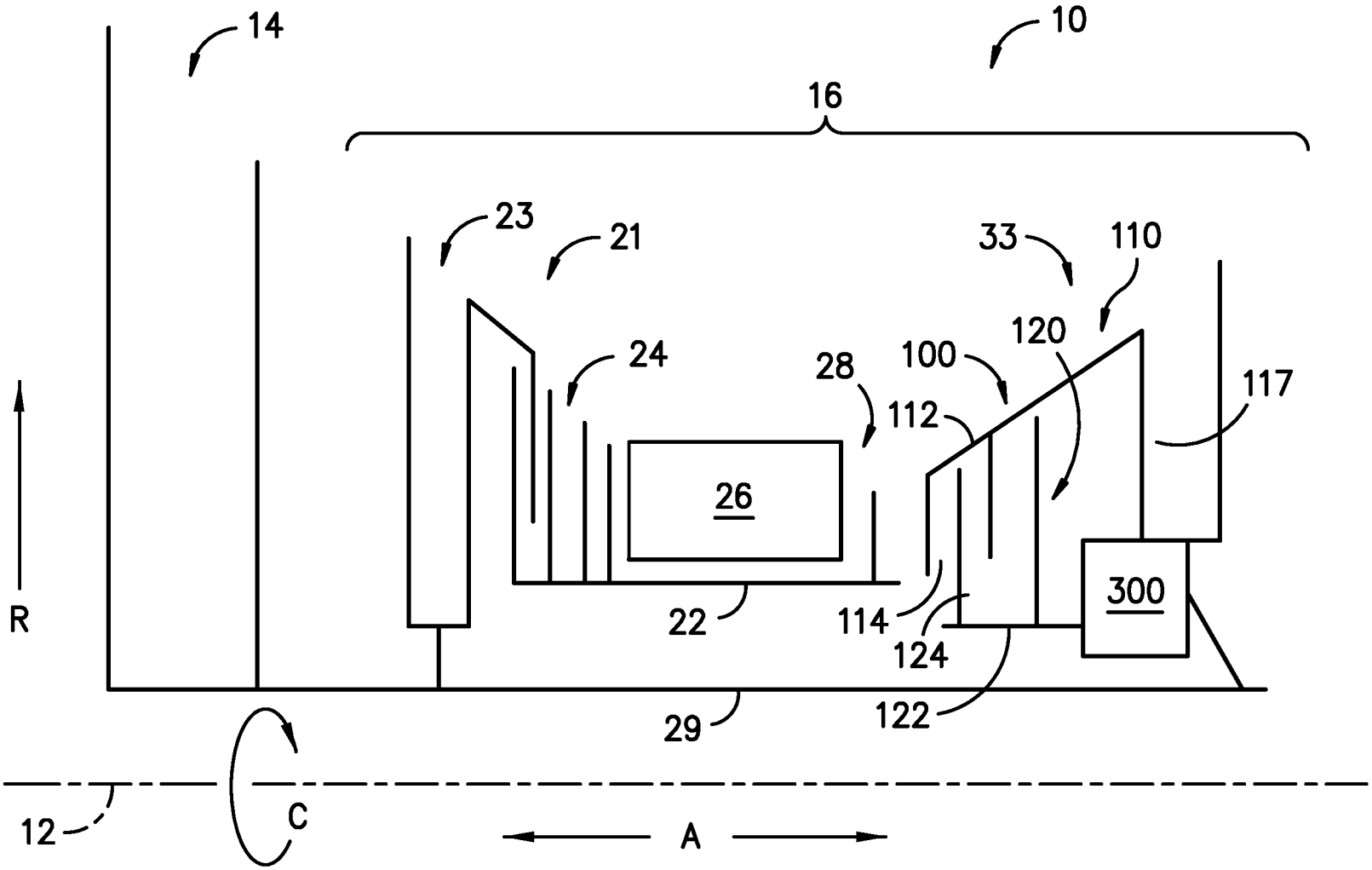
FIG. 3 is an exemplary schematic embodiment of the engine of FIGS. 1-2 according to an aspect the present disclosure.

Referring now to FIG. 3, an exemplary embodiment of the core engine 16 is provided. The core engine 16 includes a compressor section 21, a heat addition system 26, and a turbine section 33 together in serial flow arrangement. The core engine 16 is extended circumferentially relative to an engine centerline axis 12. The core engine 16 includes a high-speed spool that includes a high-speed compressor 24 and a high-speed turbine 28 operably rotatably coupled together by a high-speed shaft 22. The heat addition system 26 is positioned between the high-speed compressor 24 and the high-speed turbine 28. Various embodiments of the heat addition system 26 include a combustion section. The combustion section may be configured as a deflagrative combustion section, a rotating detonation combustion section, a pulse detonation combustion section, or other appropriate heat addition system. The heat addition system 26 may be configured as one or more of a rich-burn system or a lean-burn system, or combinations thereof. In still various embodiments, the heat addition system 26 includes an annular combustor, a can combustor, a cannular combustor, a trapped vortex combustor (TVC), or other appropriate combustion system, or combinations thereof.

Referring still to FIG. 3, the core engine 16 includes a booster or low-speed compressor 23 positioned in flow relationship with the high-speed compressor 24. The low-speed compressor 23 is rotatably coupled with the turbine section 33 via a driveshaft 29. Various embodiments of the turbine section 33 further include a turbine rotor assembly 100 including a second rotor assembly 120 and a first rotor assembly 110 interdigitated with one another. The second rotor assembly 120 and the first rotor assembly 110 are each operably connected to a gear assembly 300 to provide power to the fan assembly 14 and the low-speed compressor 23, such as described further herein. In certain embodiments, the second rotor assembly 120 and the first rotor assembly 110 are together positioned downstream of the high-speed turbine 28.

It should be appreciated that the terms "low" and "high", or their respective comparative degrees (e.g., -er, where applicable), when used with compressor, turbine, shaft, or spool components, each refer to relative speeds within an engine unless otherwise specified. For example, a "low turbine" or "low speed turbine" defines a component configured to operate at a rotational speed, such as a maximum allowable rotational speed, lower than a "high turbine" or "high speed turbine" at the engine. Alternatively, unless otherwise specified, the aforementioned terms may be understood in their superlative degree. For example, a "low turbine" or "low speed turbine" may refer to the lowest maximum rotational speed turbine within a turbine section, a "low compressor" or "low speed compressor" may refer to the lowest maximum rotational speed turbine within a compressor section, a "high turbine" or "high speed turbine" may refer to the highest maximum rotational speed turbine within the turbine section, and a "high compressor" or "high speed compressor" may refer to the highest maximum rotational speed compressor within the compressor section. Similarly, the low speed spool refers to a lower maximum rotational speed than the high speed spool. It should further be appreciated that the terms "low" or "high" in such aforementioned regards may additionally, or alternatively, be understood as relative to minimum allowable speeds, or minimum or maximum allowable speeds relative to normal, desired, steady state, etc. operation of the engine.

In certain embodiments, such as depicted in FIG. 3, the core engine 16 includes one or more interdigitated structures at the compressor section 21 and/or the turbine section 33. In one embodiment, the turbine section 33 includes a turbine rotor assembly 100 including the first rotor assembly 110 interdigitated with the second rotor assembly 120, such as via a rotating outer shroud, drum, casing, or rotor. It should be appreciated that embodiments of the turbine section 33 may include the first and/or second turbine 110, 120 interdigitated with one or more stages of the high-speed turbine 28. In another embodiment, the compressor section 21 includes the low-speed compressor 23 interdigitated with the high-speed compressor 24. For instance, the higher speed compressor, such as the high-speed compressor 24, may be a first compressor interdigitated with the lower speed compressor, such as the low-speed compressor 23.

Certain embodiments of the gear assembly 300 depicted and described herein allow for gear ratios and arrangements providing for proportional rotational speed of the fan assembly 14 relative to the turbine section 33. Various embodiments of the gear assembly 300 provided herein may include gear ratios of up to 14:1. Still various embodiments of the gear assembly provided herein may include gear ratios greater than 1:1. In certain embodiments, the gear ratio is at least 3:1. Still yet various embodiments of the gear assembly provided herein include gear ratios between 3:1 to 12:1 for an epicyclic gear assembly or compound gear assembly. The second rotor speed provided herein may be proportionally greater than the first rotor speed corresponding to the gear ratio, e.g., the second rotor speed generally greater than the first rotor speed, or 3× greater, or 7× greater, or 9× greater, or 11× greater, or up to 14× greater, etc. than the first rotor speed.

Although depicted as an un-shrouded or open rotor engine, it should be appreciated that aspects of the disclosure provided herein may be applied to shrouded or ducted engines, partially ducted engines, aft-fan engines, or other turbomachine configurations, including those for marine, industrial, or aero-propulsion systems. Certain aspects of the disclosure may be applicable to turbofan, turboprop, or turboshaft engines, such as turbofan, turboprop, or turboshaft engines with reduction gear assemblies.

Figure 4:
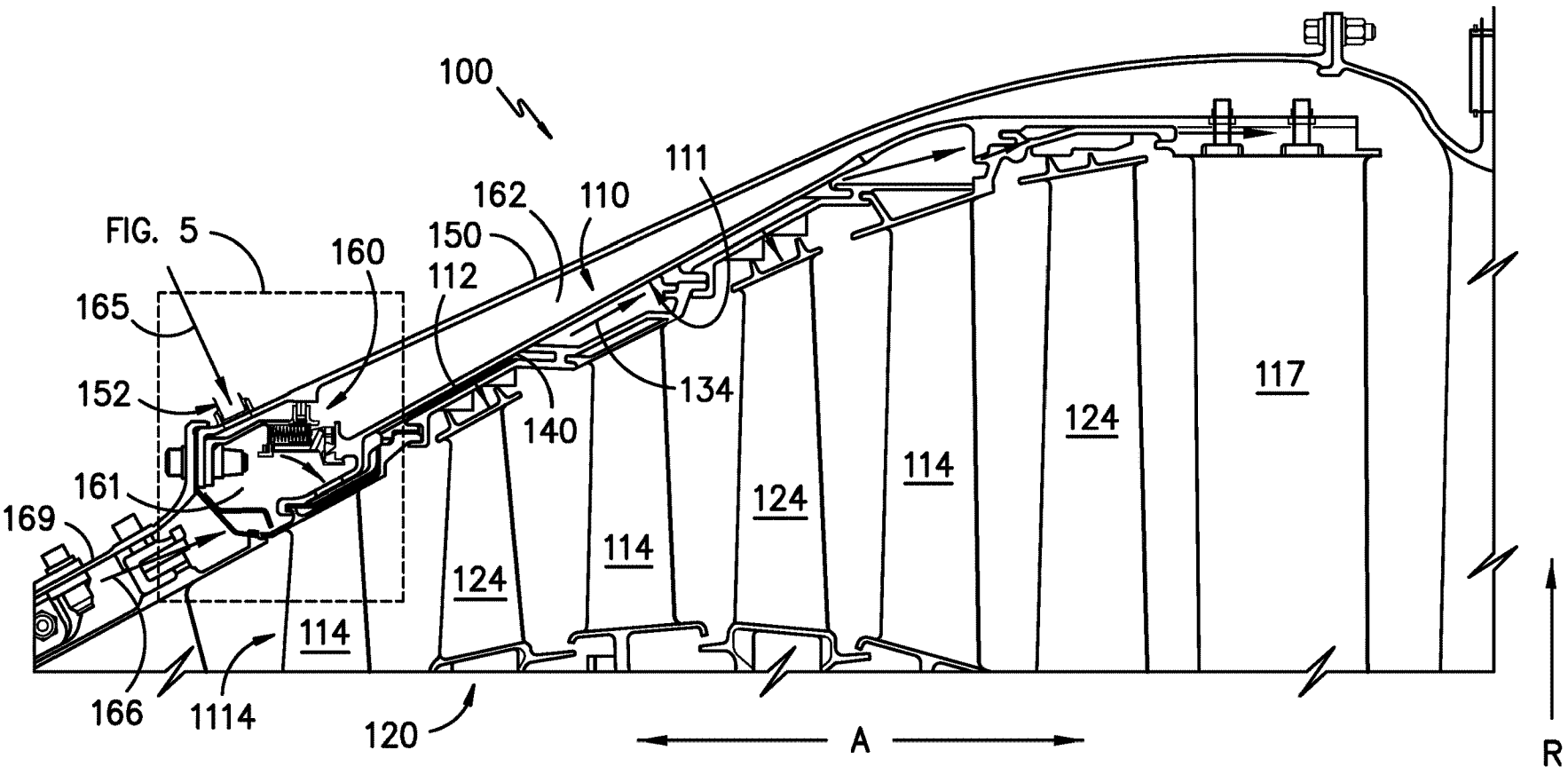
FIG. 4 is an exemplary schematic of a portion of the turbine assembly according to aspects of the present disclosure.

Referring now to FIG. 4, an embodiment of a portion of the turbine assembly 100 is provided. The turbine assembly 100 includes a first rotor assembly 110 interdigitated with a second turbine rotor assembly 120. In one embodiment, interdigitation of the first rotor assembly 110 and the second rotor assembly 120 refers to one or more rotatable stages of the first rotor assembly 110 in alternate arrangement along the flowpath axial direction A with two or more rotatable stages of the second rotor assembly 120. In another embodiment, interdigitation of the first rotor assembly 110 and the second rotor assembly 120 refers to one or more rotatable stages of the second rotor assembly 120 in alternate arrangement along the flowpath axial direction A with two or more rotatable stages of the first rotor assembly 110.

Figure 5:
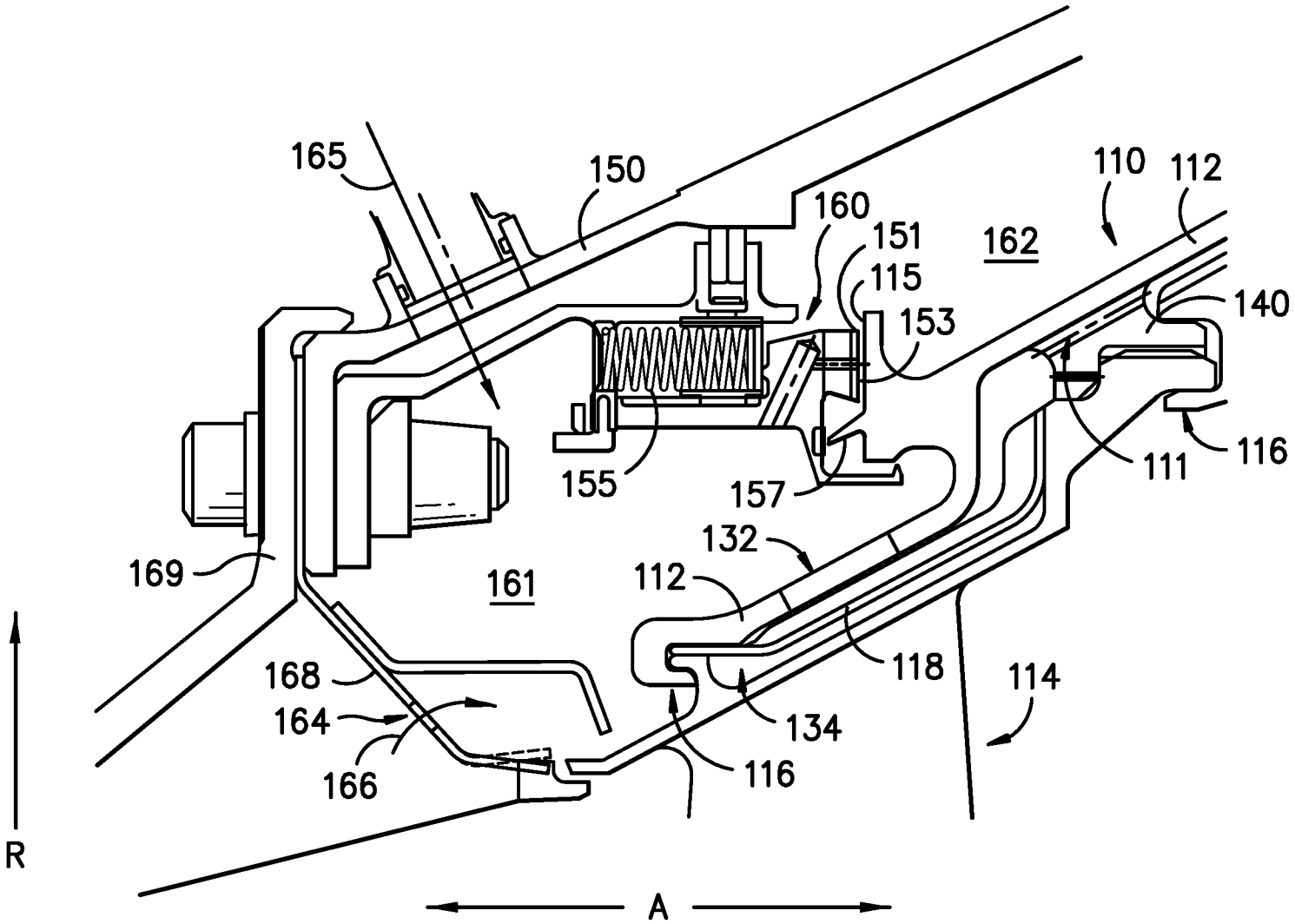
FIG. 5 is a detailed view of an embodiment of a portion of the turbine assembly of FIG. 4.

Referring to FIG. 4 and the detailed view in FIG. 5, the first rotor assembly 110 includes an outer drum 112 from which one or more stages of a plurality of outer drum airfoils 114 is extended inward along the radial direction R. Referring briefly back to FIG. 3, particular embodiments of the first rotor assembly 110 include a rotatable frame 117 from which the outer drum 112 is extended along the axial direction A. The rotatable frame 117 provides support to allow for the outer drum 112 to cantilever from the rotatable frame 117. In certain embodiments, the first rotor assembly 110 is coupled to the gear assembly 300 via the rotatable frame 117, such as via a rotatable ring gear.

The outer drum 112 forms a hanger 116 at which the plurality of outer drum airfoils 114 is attached. At least one stage of the plurality of outer drum airfoils 114 has an impeller 118 positioned between the outer drum 112 and the plurality of outer drum airfoils 114. In certain embodiments, the impeller 118 is positioned between the rotatable outer drum 112 and the plurality of outer drum airfoils 114. In a still particular embodiment, the impeller 118 is positioned along the radial direction R between the rotatable outer drum 112 and the plurality of outer drum airfoils 114.

The second rotor assembly 120 includes one or more stages of a plurality of second rotor airfoils 124 extended outward along the radial direction R and interdigitated with the one or more stages of the plurality of outer drum airfoils 114 of the first rotor assembly 110. In certain embodiments, the second rotor assembly 120 includes a disk or hub 122 at which the plurality of second rotor airfoils 124 is attached. In a particular embodiment, one or more stages of the plurality of second rotor airfoils 124 is integrally formed with the hub 122. In other embodiments, one or more stages of the plurality of second rotor airfoils 124 is detachably coupled to the hub 122. In various embodiments, the hub 122 and the second rotor airfoils 124 together form a dovetail structure at which the second rotor airfoils 124 is positioned to the hub 122.

Referring still to FIGS. 4-5, the outer drum 112 forms an opening 132 outward along the radial direction R from the plurality of outer drum airfoils 114. A cavity 134 is formed between the hanger 116, the plurality of outer drum airfoils 114, and the opening 132 at the outer drum 112. In various embodiments, the cavity 134 forms an impeller cavity at which an impeller 118 such as described herein is positioned. In a particular embodiment, the cavity 134 is formed between forward and aft hangers 116 along the axial direction A, and outward along the radial direction R from the plurality of outer drum airfoils 114 in adjacent arrangement along the circumferential direction C. In certain embodiments, the cavity 134 is formed at a respective stage of the plurality of outer drum airfoils 114. In a still particular embodiment, the cavity 134 is formed at an axially forward-most, or upstream-most, or first stage 1114 (FIG. 4) of the plurality of outer drum airfoils 114 extended from the outer drum 112. In still various embodiments, the cavity 134 is formed at least at an axially forward-most or first stage 1114 of the plurality of outer drum airfoils 114 distal along the axial direction A from the rotatable frame 117 (FIGS. 3-4).

Figure 6:
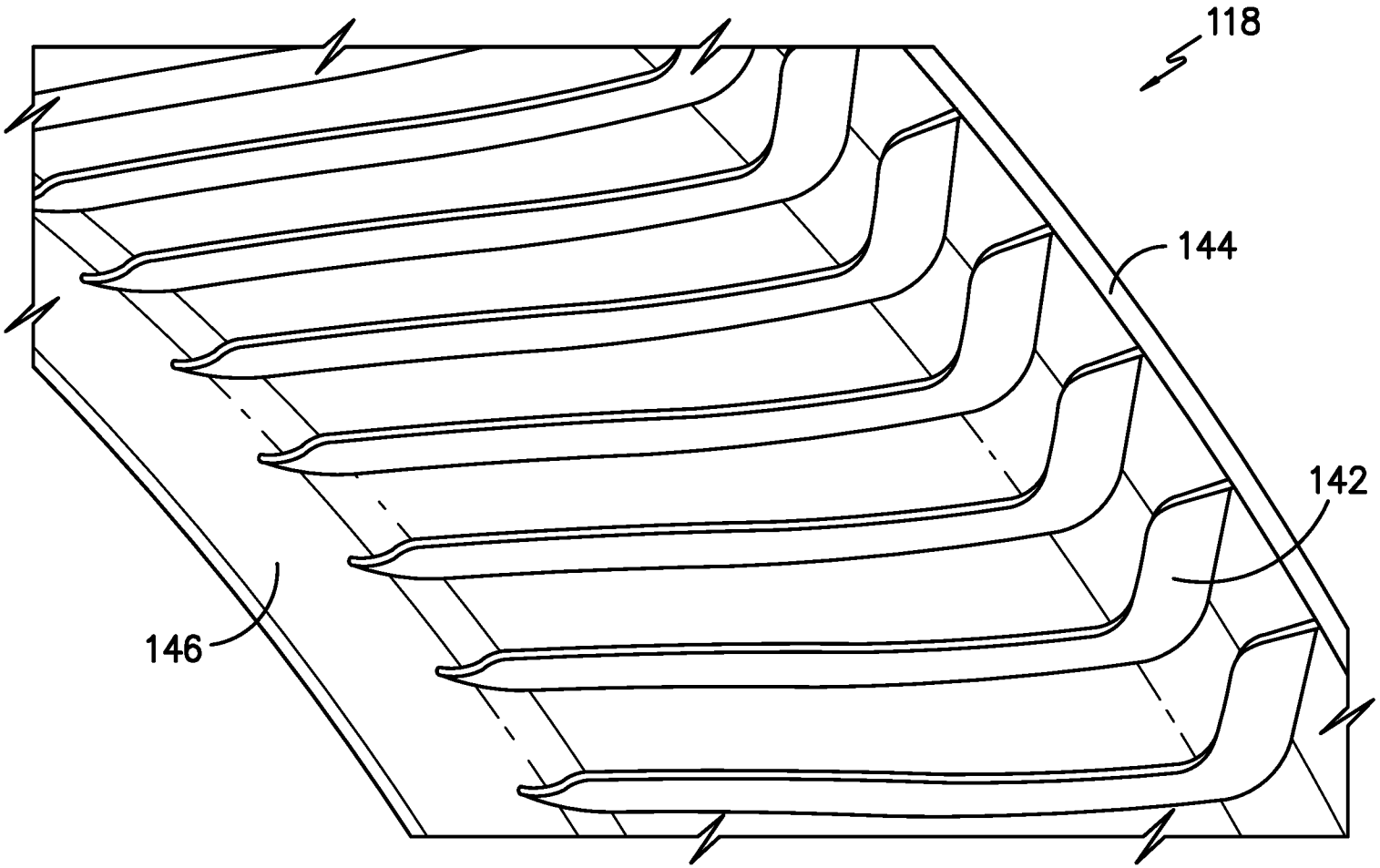
FIG. 6 is a perspective view of a portion of an embodiment of an impeller of an embodiment of the turbine assembly according to aspects of the present disclosure.

The impeller 118 is positioned in the cavity 134. In a particular embodiment, the impeller 118 is a forced-vortex generator. Referring to FIG. 6, a detailed view of an annular section of an embodiment of the impeller 118. In an embodiment, the impeller 118 includes a plurality of blades 142 extended from a shroud 144. In various embodiments, the shroud 144 is an annular structure extended along the circumferential direction C through the cavity 134. In some embodiments, the shroud 144 and respectively attached blades 142 are arranged as a plurality of sections in annular arrangement. In an embodiment, the impeller 118 includes a wall 146 extended inward along the radial direction R from the shroud 144.

In a particular embodiment, the radially extended wall 146 is positioned at a forward end of the shroud 144. The blades 142 are configured to generate a forced vortex of fluid through a flow circuit 140 during operation of the turbine assembly 100. The impeller 118 may omit the wall 146 when the impeller 118 is positioned at one or more stages of the plurality of outer drum airfoils 114 downstream of the forward-most or first stage of the plurality of outer drum airfoils 114.

The flow circuit 140 is extended along the axial direction A. The flow circuit 140 is formed between an inner surface 111 of the outer drum 112 and the hanger 116. The flow circuit 140 is in fluid communication with the opening 132 at the outer drum 112 and the cavity 134. In certain embodiments, the flow circuit 140 provides fluid communication between impeller cavities 134 at two or more axial stages. In other embodiments, the flow circuit 140 provides fluid communication from the cavity 134 at the first stage and one or more cavities downstream of the first stage and positioned between the inner surface 111 and the hangers 116 of the outer drum 112. In a particular embodiment, the flow circuit 140 is extended along the axial direction A in serial flow arrangement to the hanger 116 at respective or subsequent stages of the plurality of outer drum airfoils 114.

Referring back to FIGS. 4-5, a static or stationary outer casing 150 surrounds the outer drum 112 of the first rotor assembly 110. The outer casing 150 is extended along the circumferential direction C and surrounds the first rotor assembly 110 and the second rotor assembly 120. The outer casing 150 depicted in FIGS. 4-5 may form a portion of the outer casing 18 of the engine 10 depicted in FIG. 1. In a particular embodiment, the outer casing 150 may form a turbine static structure surrounding, or furthermore, supporting the rotors of the turbine assembly 100. The outer casing 150 may further include bearing assemblies, clearance control systems, or fluid manifolds and conduits for air, lubricant, damper fluid, heat transfer fluid, or other fluids generally provided for rotor operation, thermal management, or clearance control. A seal assembly 160 is coupled to the outer casing 150 and positioned in operable arrangement with the first rotor assembly 110. In various embodiments, the seal assembly 160 is an aspirating face seal assembly. The aspirating face seal assembly may include one or more springs 155 configured to desirably position an annular stationary face seal or wall 151 adjacent to a corresponding annular rotatable face or wall 115 at the first rotor assembly 110. A gap or space 153 between the respective stationary wall 151 and rotatable wall 115 is desirably adjusted based at least on an upstream and/or downstream pressure, such as a pressure differential at a first plenum 161 and a second plenum 162 such as further described herein. The seal assembly 160 may include one or more teeth 157 extended between the rotatable wall 115 of the first rotor assembly 110 and the stationary wall 151 of the seal assembly 160.

The outer casing 150, the seal assembly 160, and the first rotor assembly 110 together form the first plenum 161 separated by the seal assembly 160 from the second plenum 162. The second plenum 162 is formed between the outer casing 150 and the outer drum 112. In certain embodiments, the second plenum 162 is positioned axially aft of the first plenum 161. In particular embodiments, the first plenum 161 is formed by the outer casing 150, the seal assembly 160, an inter-turbine wall 168 positioned forward or upstream of the first rotor assembly 110, and an upstream end of the first rotor assembly 110.

In various embodiments, the seal assembly 160, the first plenum 161, and the second plenum 162 are each extended annularly along the circumferential direction C. However, in various embodiments, the seal assembly 160, the first plenum 161, or the second plenum 162 may be segmented or annularly sectored, bifurcated, or discontinuous along the circumferential direction C. In various embodiments, the first plenum 161 is formed outward along the radial direction R of the opening 132 at the outer drum 112. In still further embodiments, the first plenum 161 is formed outward along the radial direction R from the first stage or upstream-most stage of the plurality of outer drum airfoils 114. In a certain embodiment, the seal assembly 160 separating the first plenum 161 and the second plenum 162 is positioned outward along the radial direction R from the upstream-most or first stage of the plurality of outer drum airfoils 114, such as in axial alignment with the upstream-most or first stage of the plurality of outer drum airfoils 114.

During operation of the engine 10, the first plenum 161 receives a high pressure flow of fluid 165 (e.g., air) through an inlet opening 152 through the outer casing 150. The seal assembly 160 separates the high-pressure first plenum 161 from the relatively lower-pressure second plenum 162. The opening 132 through the outer drum 112 provides fluid communication between the first plenum 161 and the cavity 134. The fluid 165 is provided from the first plenum 161 into the cavity 134 through the opening 132. In certain embodiments, the engine 10 including the seal assembly 160 forming the aspirating face seal adjusts the gap 153 between the stationary wall 151 and the rotatable wall 115 via adjusting the pressure of fluid 165 entering the first plenum 161.

In certain embodiments, the impeller 118 is fixed to the rotatable outer drum 112 of the first rotor assembly 110. During exemplary operation of the turbine assembly 100, the forced vortex is caused at least in part by forces on the fluid 165 generated by the blades 142 of the impeller 118 during rotating of the first rotor assembly 110. The forced vortex generated by the impeller 118 forces or pumps fluid through the flow circuit 140, such as to provide for cooling at the turbine assembly 100. The impeller 118 supercharges the flow of fluid, such as to allow for multiple stages of the plurality of outer drum airfoils 114 to receive cooling flow. In certain embodiments, the impeller 118 may particularly allow for multiple stages of the plurality of outer drum airfoils 114 to receive cooling flow from a single stage of the cavity 134. In a still particular embodiment, the impeller 118 may particularly allow for multiple stages of the plurality of outer drum airfoils 114 to receive cooling flow from a single stage of the cavity 134 and a single stage of a plurality of discrete circumferentially arranged openings 132. In an alternative embodiment, the impeller 118 may particularly allow for multiple stages of the plurality of outer drum airfoils 114 to receive cooling flow from a single stage of the cavity 134 and a single opening 132 into the cavity 134.

During another exemplary operation of the turbine assembly 100, the serial flow arrangement of the inlet opening 152 allowing for flow of fluid 165 into the first plenum 161 then the cavity 134 and the flow circuit 140 allows for cooling across multiple stages of the turbine assembly 100. The first plenum 161 formed radially outward of the upstream-most or first stage of the plurality of outer drum airfoils 114 may particularly allow for reduced overall cooling flow extracted from the compressors or otherwise removed from the thermodynamic cycle at the heat addition system 26. Additionally, the structures provided herein may allow for improved fuel burn, such as by utilizing less air from the compressors for cooling at the turbine, allowing for more air to be used for generating combustion gases. In certain embodiments, the particular positioning of the first plenum 161 may allow for multiple stages of the plurality of outer drum airfoils 114 to receive cooling flow from a single stage of the cavity 134. In a still particular embodiment, the particular positioning of the first plenum 161 may allow for multiple stages of the plurality of outer drum airfoils 114 to receive cooling flow from a single stage of the cavity 134 and a single stage of a plurality of discrete circumferentially arranged openings 132.

During still another exemplary operation of the turbine assembly 100, a high pressure flow of fluid 166 from an upstream turbine, such as the high pressure turbine 28, may be provided to the first plenum 161 through an inter-turbine opening 164 through an inter-turbine wall 168 of an inter-turbine case or frame 169. The inter-turbine case or frame 169 may be a stationary structure, such as a static structure configured to support one or more bearing assemblies, lubricant or air conduits, damper systems, seal systems, or clearance control systems. The high pressure flow of fluid 166 may be recycled from a cooling function or other desired function from an upstream turbine (e.g., the high pressure turbine 28). The re-used high pressure flow of fluid 166 may then enter the cavity 134 via the opening 132 and further provide cooling to the turbine assembly 100 as described herein. Additionally, or alternatively, a mixture of fluids 165. 166 may enter the cavity 134 and flow circuit 140, allowing for a reduced overall amount of fluid to be utilized or extracted from the compressor section 21 in contrast to known turbine cooling systems, clearance control systems, or outer drum bearing systems. It should be appreciated that in various embodiments, the compressor section 21 provides a flow of compressed fluid 165 to the first plenum 161 through the inlet opening 152, such as via walled conduits or manifolds.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects of the invention are provided by the subject matter of the following clauses:

1. A turbine assembly, the turbine assembly comprising a first rotor assembly comprising a rotatable outer drum from which one or more stages of a plurality of outer drum airfoils is extended inward along a radial direction; an outer casing surrounding the outer drum of the first rotor assembly; a seal assembly coupled to the outer casing and positioned outward along the radial direction from an upstream-most stage of the plurality of outer drum airfoils, wherein the seal assembly is positioned in axial alignment with the upstream-most stage of the plurality of outer drum airfoils, wherein the seal assembly separates a first plenum from a second plenum, wherein the second plenum is formed axially aft of the first plenum, and wherein the second plenum is formed by the seal assembly, the outer casing, and the outer drum of the first rotor assembly, and wherein the first plenum is positioned outward along the radial direction from the upstream-most stage of the plurality of outer drum airfoils.

2. The turbine assembly of any clause herein, wherein the outer drum forms an opening outward along the radial direction from the plurality of outer drum airfoils, and wherein the outer drum forms a hanger at which the plurality of outer drum airfoils is attached, and further wherein a cavity is formed between the hanger, the plurality of outer drum airfoils, and the opening at the outer drum.

3. The turbine assembly of any clause herein, wherein a plurality of the opening is formed in discrete circumferential arrangement through the outer drum.

4. The turbine assembly of any clause herein, wherein the opening through the outer drum provides fluid communication between the first plenum and the cavity.

5. The turbine assembly of any clause herein, wherein the outer casing forms an inlet opening through which a fluid is allowed to flow to the first plenum and the cavity.

6. The turbine assembly of any clause herein, wherein a flow circuit is extended substantially along an axial direction, and wherein the flow circuit is formed between an inner surface of the outer drum and the hanger, and further wherein the flow circuit is in fluid communication with the opening at the outer drum and the cavity.

7. The turbine assembly of any clause herein, wherein the flow circuit is extended along the axial direction in serial flow arrangement to the hanger at respective stages of the plurality of outer drum airfoils.

8. The turbine assembly of any clause herein, wherein an impeller is positioned in the cavity.

9. The turbine assembly of any clause herein, wherein the impeller is positioned in the cavity at the upstream-most stage of the plurality of outer drum airfoils.

10. The turbine assembly of any clause herein, wherein the impeller comprises a plurality of blades extended from an annular shroud.

11. The turbine assembly of any clause herein, wherein the impeller comprises a wall extended along the radial direction from the shroud, and wherein and the wall is positioned at a forward end of the shroud, and wherein the impeller is positioned in the cavity at the upstream-most stage of the plurality of outer drum airfoils.

12. The turbine assembly of any clause herein, wherein the impeller is a forced vortex generator configured to flow fluid through a flow circuit extended substantially along an axial direction during operation of the engine.

13. The turbine assembly of any clause herein, wherein the first plenum is a higher pressure cavity than the second plenum during operation of the engine.

14. The turbine assembly of any clause herein, wherein the seal assembly is an aspirating face seal assembly.

15. The turbine assembly of any clause herein, wherein the seal assembly comprises a spring and a stationary wall positioned adjacent to a rotatable wall at the first rotor assembly, wherein a gap between the stationary wall and the rotatable wall is adjusted based at least on changes in pressure at the first plenum.

16. The turbine assembly of any clause herein, the turbine assembly comprising a second rotor assembly comprising one or more stages of a plurality of second rotor airfoils extended outward along the radial direction and interdigitated with the one or more stages of the plurality of outer drum airfoils of the first rotor assembly.

17. The turbine assembly of any clause herein, the turbine assembly comprising a high pressure turbine positioned upstream of the first rotor assembly and the second rotor assembly.

18. The turbine assembly of any clause herein, wherein an inter-turbine wall is extended from the outer casing, and wherein the first plenum is formed at least in part by the inter-turbine wall, and wherein an inter-turbine wall opening provides fluid communication to the first plenum.

19. The turbine assembly of any clause herein, the first rotor assembly comprising a rotatable frame, wherein the outer drum is extended along an axial direction from the rotatable frame.

20. The turbine assembly of any clause herein, wherein the cavity is positioned at a first stage of the plurality of outer drum airfoils distal along the axial direction from the rotatable frame.

21. The turbine assembly of any clause herein, comprising a gear assembly, wherein the first rotor assembly and the second rotor assembly are each operably coupled to the gear assembly.

22. The turbine assembly of any clause herein, wherein the first rotor assembly is coupled to the gear assembly via the rotatable frame.

23. A gas turbine engine, the engine comprising a compressor section configured to generate a flow of pressurized fluid; a first rotor assembly comprising a rotatable outer drum from which one or more stages of a plurality of outer drum airfoils is extended inward along a radial direction, wherein a cavity is formed between an upstream-most stage of the plurality of outer drum airfoils and the outer drum, and wherein the outer drum forms an opening outward along the radial direction from the plurality of outer drum airfoils; an outer casing surrounding the outer drum of the first rotor assembly; a seal assembly coupled to the outer casing and positioned outward along the radial direction from an upstream-most stage of the plurality of outer drum airfoils, wherein the seal assembly is positioned in axial alignment with the upstream-most stage of the plurality of outer drum airfoils, wherein the seal assembly separates a first plenum from a second plenum, wherein the second plenum is formed axially aft of the first plenum, and wherein the second plenum is formed by the seal assembly, the outer casing, and the outer drum of the first rotor assembly, and wherein the first plenum is positioned outward along the radial direction from the upstream-most stage of the plurality of outer drum airfoils; wherein the outer casing forms an inlet opening through which a fluid is allowed to flow to the first plenum, and wherein the opening through the outer drum allows for fluid communication from the first plenum to the cavity; and wherein the engine is configured to provide compressed fluid from the compressor section to the first plenum through the inlet opening at the outer casing.

24. The gas turbine engine of any clause herein, wherein an impeller is positioned in the cavity.

25. The gas turbine engine of any clause herein, comprising the turbine assembly of any clause herein.

What is claimed is:

1. A turbine assembly, the turbine assembly comprising:

a first rotor assembly comprising a rotatable outer drum from which one or more stages of a plurality of outer drum airfoils is extended inward along a radial direction;

an outer casing surrounding the outer drum of the first rotor assembly; and a seal assembly coupled to the outer casing and positioned outward along the radial direction from an upstream-most stage of the plurality of outer drum airfoils, wherein the seal assembly is positioned in axial alignment with the upstream-most stage of the plurality of outer drum airfoils, wherein the seal assembly separates a first plenum from a second plenum, wherein the second plenum is formed axially aft of the first plenum, and wherein the second plenum is formed by the seal assembly, the outer casing, and the outer drum of the first rotor assembly, and wherein the first plenum is positioned outward along the radial direction from the upstream-most stage of the plurality of outer drum airfoils.

2. The turbine assembly of claim 1, wherein the outer drum forms an opening outward along the radial direction from the plurality of outer drum airfoils, and wherein the outer drum forms a hanger at which the plurality of outer drum airfoils is attached, and further wherein a cavity is formed between the hanger, the plurality of outer drum airfoils, and the opening at the outer drum.

3. The turbine assembly of claim 2, wherein a plurality of the opening is formed in discrete circumferential arrangement through the outer drum.

4. The turbine assembly of claim 2, wherein the opening through the outer drum provides fluid communication between the first plenum and the cavity.

5. The turbine assembly of claim 4, wherein the outer casing forms an inlet opening through which a fluid is allowed to flow to the first plenum and the cavity.

6. The turbine assembly of claim 5, wherein a flow circuit is extended substantially along an axial direction, and wherein the flow circuit is formed between an inner surface of the outer drum and the hanger, and further wherein the flow circuit is in fluid communication with the opening at the outer drum and the cavity.

7. The turbine assembly of claim 6, wherein the flow circuit is extended along the axial direction in serial flow arrangement to the hanger at respective stages of the plurality of outer drum airfoils.

8. The turbine assembly of claim 2, wherein an impeller is positioned in the cavity.

9. The turbine assembly of claim 8, wherein the impeller is positioned in the cavity at the upstream-most stage of the plurality of outer drum airfoils.

10. The turbine assembly of claim 8, wherein the impeller comprises a plurality of blades extended from an annular shroud.

11. The turbine assembly of claim 10, wherein the impeller comprises a wall extended along the radial direction from the shroud, and wherein and the wall is positioned at a forward end of the shroud, and wherein the impeller is positioned in the cavity at the upstream-most stage of the plurality of outer drum airfoils.

12. The turbine assembly of claim 8, wherein the impeller is a forced vortex generator configured to flow fluid through a flow circuit extended substantially along an axial direction during operation of the turbine assembly.

13. The turbine assembly of claim 1, wherein the first plenum is a higher pressure cavity than the second plenum during operation of the turbine assembly.

14. The turbine assembly of claim 1, wherein the seal assembly is an aspirating face seal assembly.

15. The turbine assembly of claim 14, wherein the seal assembly comprises a spring and a stationary wall positioned adjacent to a rotatable wall at the first rotor assembly, wherein a gap between the stationary wall and the rotatable wall is adjusted based at least on changes in pressure at the first plenum.

16. The turbine assembly of claim 1, the turbine assembly comprising:

a second rotor assembly comprising one or more stages of a plurality of second rotor airfoils extended outward along the radial direction and interdigitated with the one or more stages of the plurality of outer drum airfoils of the first rotor assembly.

17. The turbine assembly of claim 16, the turbine assembly comprising:

a high pressure turbine positioned upstream of the first rotor assembly and the second rotor assembly.

18. The turbine assembly of claim 17, wherein an inter-turbine wall is extended from the outer casing, and wherein the first plenum is formed at least in part by the inter-turbine wall, and wherein an inter-turbine wall opening provides fluid communication to the first plenum.

19. A gas turbine engine, the engine comprising:

a compressor section configured to generate a flow of pressurized fluid;

a first rotor assembly comprising a rotatable outer drum from which one or more stages of a plurality of outer drum airfoils is extended inward along a radial direction, wherein a cavity is formed between an upstream-most stage of the plurality of outer drum airfoils and the outer drum, and wherein the outer drum forms an opening outward along the radial direction from the plurality of outer drum airfoils;

an outer casing surrounding the outer drum of the first rotor assembly;

a seal assembly coupled to the outer casing and positioned outward along the radial direction from the upstream-most stage of the plurality of outer drum airfoils, wherein the seal assembly is positioned in axial alignment with the upstream-most stage of the plurality of outer drum airfoils, wherein the seal assembly separates a first plenum from a second plenum, wherein the second plenum is formed axially aft of the first plenum, and wherein the second plenum is formed by the seal assembly, the outer casing, and the outer drum of the first rotor assembly, and wherein the first plenum is positioned outward along the radial direction from the upstream-most stage of the plurality of outer drum airfoils;

wherein the outer casing forms an inlet opening through which a fluid is allowed to flow to the first plenum, and wherein the opening through the outer drum allows for fluid communication from the first plenum to the cavity; and wherein the engine is configured to provide compressed fluid from the compressor section to the first plenum through the inlet opening at the outer casing.

20. The gas turbine engine of claim 19, wherein an impeller is positioned in the cavity.

* * * * *